US006626159B1

(12) United States Patent
Hans et al.

(10) Patent No.: US 6,626,159 B1
(45) Date of Patent: Sep. 30, 2003

(54) GAS DISTRIBUTOR APPARATUS FOR FUEL-INJECTION SYSTEMS

(75) Inventors: Waldemar Hans, Bamberg (DE); Jörg Lange, Eberdingen (DE); Thomas Betzel, Bamberg (DE); Christian Preussner, Markgröningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 08/637,656

(22) PCT Filed: May 26, 1995

(86) PCT No.: PCT/DE95/00694

§ 371 (c)(1),
(2), (4) Date: Jul. 19, 1996

(87) PCT Pub. No.: WO96/07026

PCT Pub. Date: Mar. 7, 1996

(30) Foreign Application Priority Data

Sep. 1, 1994 (DE) ..... 44 31 044

(51) Int. Cl.[7] ..... F02M 23/00
(52) U.S. Cl. ..... 123/531; 123/456
(58) Field of Search ..... 123/531, 533, 123/456, 468, 469

(56) References Cited

U.S. PATENT DOCUMENTS

| | | | | | |
|---|---|---|---|---|---|
| 4,693,224 | A | * | 9/1987 | McKay | 123/531 |
| 4,962,745 | A | * | 10/1990 | Ohno | 123/533 |
| 5,046,472 | A | * | 9/1991 | Linder | 123/533 |
| 5,085,189 | A | * | 2/1992 | Huang | 123/533 |
| 5,094,217 | A | * | 3/1992 | Kaku et al. | 123/533 |
| 5,101,800 | A | * | 4/1992 | Schumann | 123/531 |
| 5,119,792 | A | * | 6/1992 | Gu | 123/533 |
| 5,123,399 | A | * | 6/1992 | Motoyama et al. | 123/531 |
| 5,156,133 | A | * | 10/1992 | Sugimoto et al. | 123/533 |
| 5,531,202 | A | * | 7/1996 | Lorraine | 123/533 |

FOREIGN PATENT DOCUMENTS

| | | | | |
|---|---|---|---|---|
| DE | 42 05 709 | | 8/1993 | |
| EP | 0 357 498 | | 3/1990 | |
| JP | 2207122 | * | 8/1990 | 123/531 |

* cited by examiner

*Primary Examiner*—Carl S. Miller
(74) *Attorney, Agent, or Firm*—Kenyon & Kenyon

(57) ABSTRACT

The gas distributor apparatus has a common gas-supply line for supplying gas to a plurality of devices, e.g., arranged in series, the gas-supply line representing a substructure with an inner supply orifice and connecting pieces, which conform in number to the devices for injecting a fuel-gas mixture, and which extend in a normal direction starting from the gas-supply line and contain branched-off ports that communicate directly with the supply orifice. A permanent connection is established between the gas distributor apparatus and the devices in that gas-intake ducts are configured on the gas-containing bodies at least partially surrounding the devices, the gas-intake ducts having functional elements and projecting with these elements into the connecting pieces of the gas distributor apparatus. The gas is made available simultaneously for all devices in the supply orifice and then flows in each case via one connecting piece to a device. Thus, the gas distributor device represents a very compact assembly, which is very simple to assemble and disassemble. The gas distributor device is especially suited for fuel-injection systems of mixture-compressing internal combustion engines having externally supplied ignition.

12 Claims, 3 Drawing Sheets

GAS DISTRIBUTOR APPARATUS FOR FUEL-INJECTION SYSTEMS

FIELD OF THE INVENTION

The present invention relates to a gas distributor apparatus for fuel-injection systems of internal combustion engines for supplying gas to at least two devices for injecting a fuel-gas mixture in accordance with the species defined in the main claim.

BACKGROUND OF THE INFORMATION

It is already disclosed by the European Patent No. 0 357 498 to arrange devices for injecting a fuel-gas mixture in receiving bores of an intake manifold of the internal combustion engine. A gas feed duct, which communicates with a gas line in the form of a hose running outside of the intake manifold, opens through into each of the receiving bores. The disadvantage of supplying gas to devices in this manner for injecting a fuel-gas mixture is that a separate gas line that runs outside of the intake manifold is required for each device. Because of the complicated design and costly assembly, this leads to high manufacturing costs for the fuel-injection system. A further disadvantage is entailed by the complex design of the intake manifold. Moreover, when the intake manifold heats up, the gas is also heated, so that the result is a decrease in the volume flowing through.

Furthermore the German Patent Application No. 42 05 709 already discloses a gas distributor for fuel-injection systems for mutually supplying gas to a plurality of devices, e.g., to fuel injectors for injecting a fuel-gas mixture. The configuration of the gas distributor is such that receiving bores and gas supply lines joining said bores are provided in conformance with the number of fuel injectors. The receptacles having the receiving bores for the fuel injectors are realized as gas-containing bodies, which radially surround the downstream ends of the fuel injectors. In this case, one does without a costly supplying of the fuel injectors with gas for injecting a fuel-gas mixture by means of individual gas lines in the form of hoses or pipe conduits running separately to each fuel injector.

However, the structural refinement of the gas distributor requires that the individual fuel injectors always be supplied with gas as directly coupled injectors, since the gas-supply lines run from receptacle to receptacle. Thus, for example, the last fuel injector to be installed in the gas distributor is supplied with gas that has already flowed through all the other receiving bores. In addition, very narrow installation tolerances must be observed to ensure a precise assembly of the relatively rigid gas distributor.

SUMMARY OF THE INVENTION

In contrast, the advantage of the gas distributor apparatus according to the present invention is that a simple, inexpensive, reliable, and easily manipulable shared supplying of a plurality of devices with gas, e.g., of fuel injectors for injecting a fuel-gas mixture is guaranteed. The gas distributor apparatus constitutes a very compact unit that is able to be assembled and disassembled on the devices very simply. The gas distributor apparatus in accordance with the present invention makes it possible to avoid a multiplicity of separately running gas lines, since a plurality of devices, e.g., arranged in series, are supplied at the same time by this one gas distributor apparatus. In addition, the gas distributor apparatus advantageously has a gas-supply line with an inner supply orifice, from which branched-off ports are introduced in connecting pieces, said branched-off ports conforming in number to the number of devices to be supplied with gas and said branched-off ports communicating directly with gas-containing bodies of the devices.

Thus, the gas is simultaneously made available for all devices in the supply orifice of the gas-supply line and then flows via each connecting piece that is formed in one piece with the gas-supply line to a device. Without circumflowing all the devices, gas is supplied separately to each device using the only one compact gas distributor apparatus, so that each device is supplied with a comparatively cool gas, through which means a better charging is achieved. It is especially advantageous that the gas-distributor device is able to be assembled and disassembled very simply, as there is no need whatsoever to change the position of the devices.

It is especially advantageous for the gas distributor apparatus of the present invention to be manufactured in one piece out of the gas-supply line that runs along a longitudinal axis of the gas distributor, with the connecting pieces constructed to correspond to the number of devices, together with an electrical socket connector (contact) strip, which is used for the electrical contacting of the devices, and with a connecting element that joins the gas-supply line to the electrical socket connector strip. The gas distributor apparatus forms an especially compact assembly when the gas-supply line, the electrical socket connector strip, and the connecting element have the same axial extent along the longitudinal axis of the gas distributor. Thus, this combined gas distributor apparatus manufactured, e.g., from plastic fulfills two functions, namely supplying the devices with gas for fuel containment and simultaneously providing for the electrical contacting of the devices.

To be able to establish a simple and rapid connection between the gas-containing bodies surrounding the devices for injecting a fuel-gas mixture and the gas distributor apparatus, it is beneficial for the gas-intake ducts that project out of the gas-containing bodies, as well as the connecting pieces of the gas-distributor device to have functional elements which cooperate with snap-in, plug-in, or snap-fit connections.

DETAILED DESCRIPTION OF THE INVENTION

Figure 1:
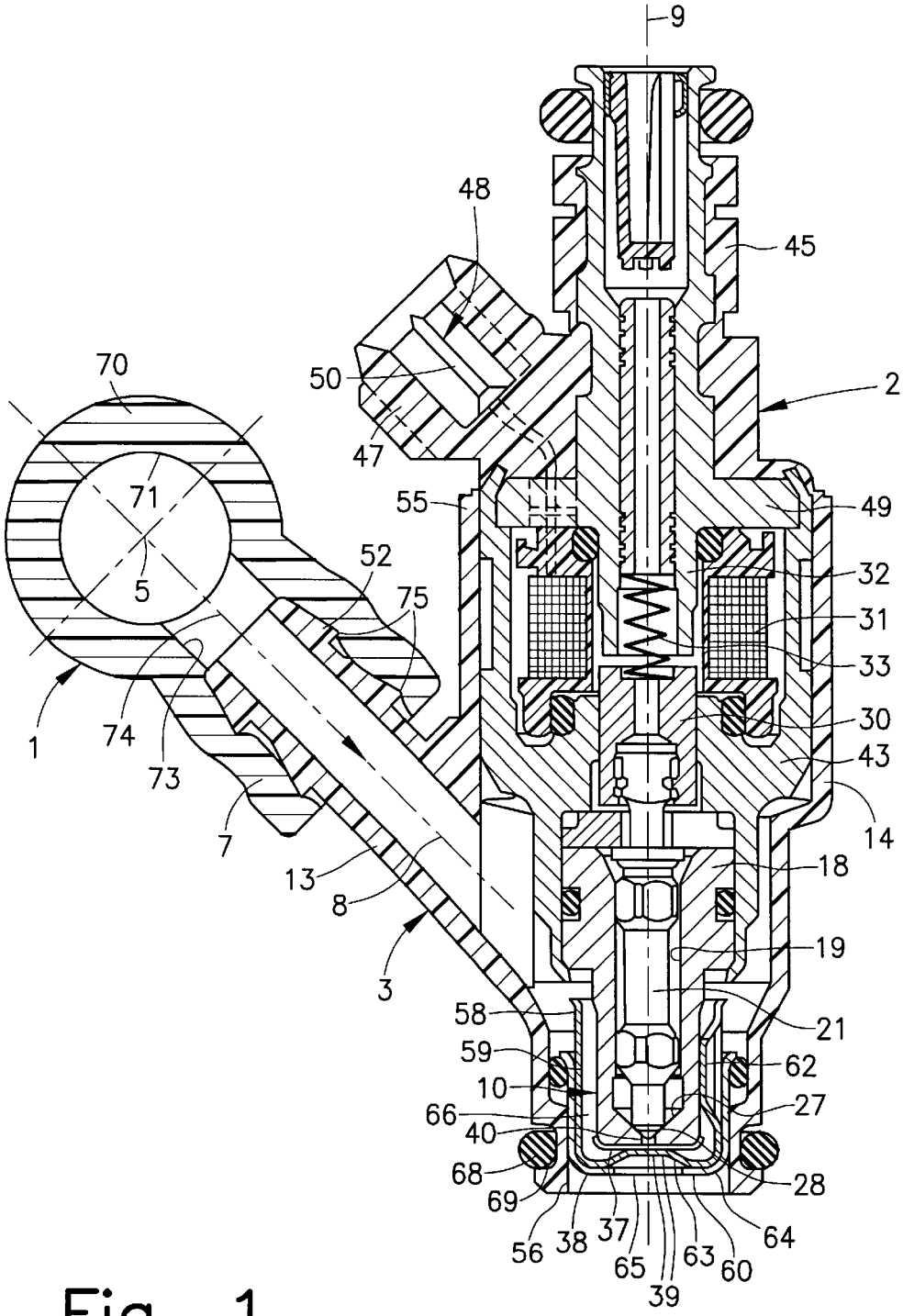
FIG. 1 shows a sectional view of a gas distributor apparatus that is mounted on a fuel injector according to an embodiment of the present invention.

FIG. 1 illustrates a gas distributor apparatus 1 for fuel-injector systems of, e.g., mixture-compressing internal combustion engines having externally supplied ignition for the mutual supplying of gas to at least two devices for injecting a fuel-gas mixture, together with such a device, here a fuel injector 2. A gas-containing body 3 that largely surrounds the fuel injector 2 provides for the requisite connection of the gas distributor apparatus 1 and the fuel injector 2 to supply gas to the fuel injector. The, e.g., elongated gas distributor apparatus 1 has a number of connecting pieces 7, disposed, e.g., equidistantly from one another along a gas-distributor longitudinal axis 5 running normal to the drawing plane in FIG. 1, that corresponds to the number of fuel injectors 2 to be supplied with gas, the connection to the gas-containing body 3 being able to be established with said connecting pieces 7. The connecting pieces 7 of the gas distributor apparatus 1 each extend along a gas-intake duct axis 8, which runs, e.g., normal to the longitudinal axis 5 of the gas distributor apparatus 1. The elongated form of the gas distributor apparatus 1 and the arrangement of the connecting pieces 7 are especially discernible in FIG. 4.

The fuel injector 2 extends together with the gas-containing body 3 along a longitudinal valve axis 9 that is not normal to the gas-intake duct axis 8, the gas-containing body 3 comprising at least one valve end 10 of the fuel injector 2. The gas-containing body 3 is comprised of a gas-intake duct 13, which, in the same way as the connecting piece 7 of the gas distributor apparatus 1, is disposed concentrically to the gas-intake duct axis 8, and of a tubular, graduated (stepped) enclosure-type casing 14, which surrounds the fuel injector 2 radially over a large portion of its axial extent. The following brief description of the fuel injector 2 is merely for exemplary purposes, since completely different types of units, devices or valves that are designed to be surrounded by gas, are also able to be equipped with the gas-containing body 3 and coupled to the gas distributor apparatus 1 in accordance with the invention.

The electromagnetically actuated fuel injector 2, for example, described in FIG. 1 has a nozzle body 18 as part of a valve housing that extends up to the valve end 10. Fashioned in the nozzle body 18 is a graduated longitudinal bore 19, which runs concentrically to the longitudinal valve axis 9 and has an, e.g., needle-shaped valve-closure part 21 configured therein. The valve-closure part 21 has, e.g., two guide sections, which, together with the inner wall of the longitudinal bore 19 of the nozzle body 18, serve to guide the valve-closure part 21. In its downstream end, the longitudinal bore 19 of the nozzle body 18 has a frustoconically tapered, fixed valve seat 27, which, together with a sealing section 28 of the valve-closure part 21 that is tapered frustoconically in the direction of fuel flow, forms a seat valve. At its end facing away from the sealing section 28, the valve-closure part 21 is joined to a tubular armature 30, which interacts with a solenoid coil 31 partially surrounding the armature 30 in the axial direction and with a tubular internal pole 32 of the fuel injector 2 opposing the armature 30 on the side facing away from the fixed valve seat 27. Engaging on the end of the valve-closure part 21 connected to the armature 30 is a restoring spring 33, which endeavors to move the valve-closure part 21 in the direction of the fixed valve seat 27.

Engaging directly on a downstream front side 37 of the valve end 10 of the fuel injector 2 is an apertured spray disk 38. The apertured spray disk 38 has, e.g., two or four spray orifices 39, through which fuel flowing past the valve seat 27, given a lifted valve-closure part 21, and arriving in an end duct 40 of the longitudinal bore 19 facing the spray orifices 39, is sprayed off.

Likewise belonging to the valve housing of the fuel injector 2 is a valve casing 43, which is constructed, e.g., from a ferromagnetic material and radially surrounds the solenoid coil 31, extends axially from the internal pole 32 up to the nozzle body 18, and is joined to both subassemblies.

The internal pole 32 and the valve casing 43 are at least partially surrounded in the axial direction by a plastic extrusion coating (sheathing) 45. An electrical plug connector 47 used to electrically contact, and thus excite the solenoid coil 31 is formed together with the plastic extrusion coating 45. Two metallic connector pins 48, which are directly connected to the winding of the solenoid coil 31, belong to the plug connector 47 that is manufactured from plastic. The connector pins 48 project out of a coil brace 49, which surrounds the solenoid coil 31 and is made of plastic, and are largely extrusion-coated with plastic. The connector pins 48 first lie exposed at their pin end 50, thus enabling a plug-in connection with a corresponding socket part that is not shown in FIG. 1.

At its upper end 55 facing the plug connector 47, the enclosure-type casing 14 of the gas-containing body 3 is permanently and imperviously joined to the fuel injector 2 and surrounds the valve casing 43, adjoining it radially in the area of the end of the coil brace 49 directed toward the plug connector 47. The permanent connection between the gas-containing body 3 and the fuel injector 2 is achieved, e.g., by pressing on and/or ultrasonically welding on the enclosure-type casing 14 of the gas-containing body 3 with its end 55 to the periphery of the valve casing 43 of the fuel injector 2, without a sealing element being required. The tubular gas-intake duct 13, which belongs to the gas-containing body 3, is formed concentrically around the gas-intake duct axis 8, and is used for directly supplying a gas to the fuel injector 2, opens through, viewed in the direction of fuel flow, underneath the permanent and impervious connection between the upper end 55 and a lower (closure) end 56 of the gas-containing body 3, into the enclosure-type casing 14 so as to allow the gas flowing in through the gas-intake duct 13 to arrive unimpeded in a pot-shaped gas-containing sleeve 58 arranged between the enclosure-type casing 14 and the valve end 10.

With one cylinder part 59, the gas-containing sleeve 58 axially surrounds the valve end 10 of the fuel injector 2, at least in part, and, with one base part 60, radially surrounds said valve end 10, at least in part. In this exemplary embodiment of the present invention, the gas-containing sleeve 58 has a two-part design with an inner and an outer pot-shaped form of, e.g., sheet metal or plastic. The outer pot-shaped form is mainly used for sealing purposes in the gas-containing body 3, while the inner pot-shaped form, because of brackets 62 projecting from the cylinder part 59 to the nozzle body 18, has an aligning function, and because of a radial section 63 projecting from the base part 60 to the apertured spray disk 38, has a gas-metering function. Configured between the apertured spray disk 38 and the radial section 63 of the base part 60 is, namely, an annular gas gap 64, which is defined, e.g., by spacer elements, such as knobs, that contact the apertured spray disk 38. Running, for example, concentrically to the longitudinal valve axis 9, both the inner pot-shaped form as well as the outer pot-shaped form have passthrough orifices 65 in the base part 60 of the gas-containing sleeve 58. Thus, the gas flows through the gas-intake duct 13, arrives in a gas ring-type duct 66 delimited in the radial direction by the inner wall of the cylinder part 59 of the inner pot-shaped form and by the periphery of the nozzle body 18 of the fuel injector 2, and attains the annular gas gap 64. The axially narrow, annular gas gap 64 formed radially between the apertured spray disk 38 and the radial section 63 of the base part 60 is used for supplying the gas to the fuel dispensed through the spray orifices 39 and for metering the gas. The small axial extent of the narrow annular gas gap 64 in the direction of the longitudinal valve axis 9 substantially accelerates the supplied gas, which in turn atomizes the fuel quite finely, so that the emissions from the internal combustion engine are reduced. Finally, the fuel-gas mixture emerges through the passthrough orifices 65 out of the gas-containing sleeve 58 and, thus, out of the fuel injector 2.

As gas, one can use, e.g., vacuum intake air branched off through a by-pass in front of (and upstream from) a throttle valve in an intake manifold of the internal combustion engine, air delivered through an auxiliary fan, but also recirculated exhaust from the internal combustion engine, or a mixture of air and exhaust. By using recirculated exhaust, one is able to reduce the emission of pollutants from the internal combustion engine.

An acute angle is formed by the longitudinal valve axis 9 and the gas-intake duct axis 8. In conformance with the requirements in the internal combustion engine and the design of the gas distributor apparatus 1, according to the present invention, the angle formed by the gas-intake duct 13 and the longitudinal valve axis 9 can be varied when working with different gas-containing bodies 3. At its end facing away from the valve casing 43, the tubular gas-intake duct 13 has at least one functional element 52, which corresponds to the connecting piece 7 of the gas distributor apparatus 1, in order to achieve a permanent connection, which will be elucidated further. By this means, the connecting piece 7 of the gas distributor apparatus 1, which is hose-shaped in form and is slid on to the gas-intake duct 13 in the area of the functional elements 52, is prevented from slipping or breaking away.

With its enclosure-type casing 14 that is axially and radially contiguous to the gas-intake duct 13, the form of the gas-containing body 3 resembles the outer contour of the fuel injector 2. The gas-intake duct 13 and the enclosure-type casing 14 are manufactured from one plastic that is characterized by high temperature resistance and high dimensional stability to permit the use of ultrasonic welding as a jointing method. A sealing ring 68 is disposed in an annular groove 69 provided between the gas-intake duct 13 and the end (closure) 56 at the enclosure-type casing 14. It is used to provide sealing action between the periphery of the gas-containing body 3 and a valve seat (not shown), which can be configured, e.g., on the intake manifold of the internal combustion engine.

In addition to the connecting pieces 7, which are manufactured to conform with the number of fuel injectors 2 to be supplied with a gas, the gas distributor apparatus 1 is also constructed from an elongated, traversing, tubular gas-supply line 70. The gas distributor apparatus 1 that can also be described as an "air rail" can be manufactured from metal, plastic or rubber. The central gas-supply line 70, as the actual substructure of the gas distributor apparatus 1 has, e.g., a circular cross-section. An elongated supply orifice 71, likewise having a circular cross-section, extends in the gas-supply line 70, concentrically to the longitudinal axis 5 of the gas distributor. At defined, e.g. equal, distances, which depend on the configuration of the fuel injectors 2, branched-off ports 73 having center axes 74 emerge from the supply orifice 71, in each case concentrically to the gas-intake duct axes 8, said branched-off ports 73 representing the inner orifices of the connecting pieces 7. The diameter of the branched-off ports 73 is, e.g., smaller than or equal to that of the supply orifice 71. The center axes 74 of the branched-off ports 73 coincide in this case, e.g., with the gas-intake duct axes 8.

In the first exemplary embodiment of the present invention as shown in FIG. 1, the gas distributor apparatus 1 is manufactured from rubber. When the gas distributor apparatus 1 is mounted on the gas-containing bodies 3, the functional elements 52 ensure permanent connections, as the connecting pieces 7 are slid on to the gas-intake ducts 13, or rather the gas-intake ducts 13 are inserted into the branched-off ports 73 of the connecting pieces 7. In this exemplary embodiment, the functional elements 52 consist of two wedge-shaped or conical retention sections 75, arranged one after the other, which are customary for connections with hoses. The connecting piece 7, as a flexible connecting hose, is placed around the retention sections 75 and completely surrounds them in the circumferential direction. The connecting piece 7 is held fast on the gas-intake duct 13 by the projections and valleys which make up a barbed configuration resembling a saw-tooth-shape. A safety catch feature is also given because the connecting piece 7 reacts to stress radially in the manner of hose, so that it is assured that the connecting piece 7 will be relieved of stress in the radial direction toward the gas-intake duct axis 8.

Figure 3:
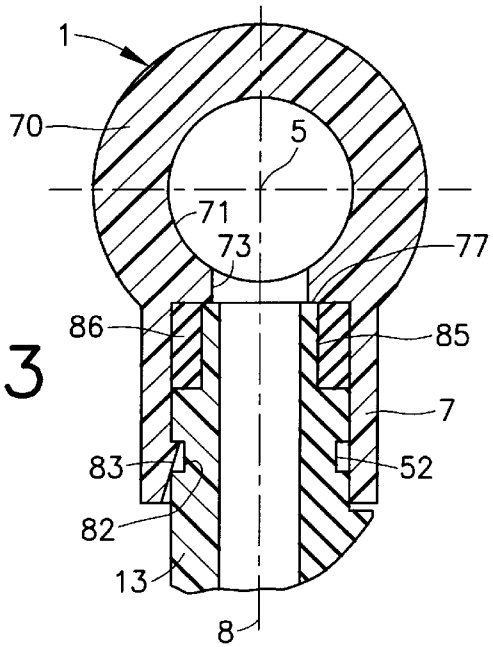
FIG. 3 shows a partial representation of the gas distributor apparatus according to yet another embodiment of the present invention.
Figure 2:
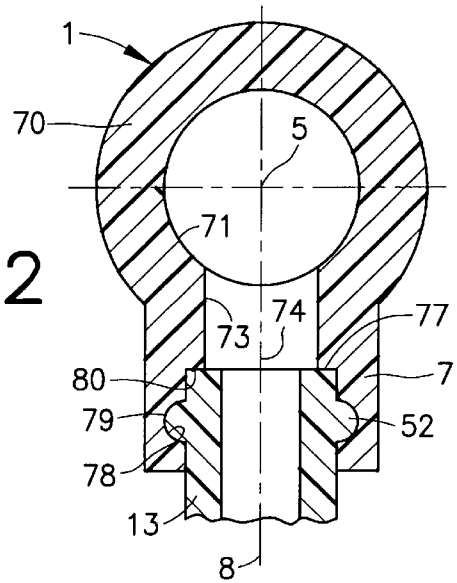
FIG. 2 shows a partial representation of the gas distributor apparatus in the area of a connecting piece according to another embodiment of the present invention.

In simplified illustrations, FIGS. 2 and 3 show sections through the gas distributor apparatus 1, in each case in the area of one connecting piece 7. It is especially in the design of the connecting piece 7 and the functional elements 52 of the gas-intake duct 13 for retaining the gas distributor apparatus 1 that the exemplary embodiments depicted in FIGS. 2 and 3 differ from the exemplary embodiment shown in FIG. 1. Apart from that, those parts in the other exemplary embodiments which remained the same or have the same function as those in FIG. 1 are characterized by the same reference symbols. The gas distributor apparatus 1 depicted in FIG. 2 is a component, for example, manufactured of plastic or rubber. The connecting piece 7, which extends, again starting from the gas-supply line 70, concentrically along the center axis 74, or rather along the gas-intake duct axis 8, is very simple in design. With its tubular contour, the connecting piece 7 has a constant outer diameter, while the inner wall or rather the branched-off port 73 has a graduated design, allowing it to be optimally placed on the outer contour of the gas-intake duct 13 in the area of the functional elements 52 and of a front side 77 of the gas-intake duct 13 facing away from the enclosure-type casing 14. In addition, at its end facing away from the valve casing 43, the tubular gas-intake duct 13 has a protuberance 78, which wraps around radially and can engage with a circumferential groove 79 provided on the inner wall of the connecting piece 7. Therefore, in this exemplary embodiment of the present invention, the protuberance 78 represents the functional element 52. A shoulder 80 of the connecting piece 7 formed in the branched-off port 73 fits, e.g., with geometrical accuracy on the front side 77 of the gas-intake duct 13. Besides the locking into place of the functional element 52, an additional safety catch feature can likewise be achieved through a radially acting tensioning of the connecting piece 7.

FIG. 3 depicts a gas distributor apparatus 1, partially in section, in the area of a connecting piece 7, which is manufactured from plastic. In contrast to the exemplary embodiment shown in FIG. 2, it is not the connecting piece 7, but rather the gas-intake duct 13 that has a groove 82 for latching purposes, which is formed, e.g., circumferentially on the outer contour of the gas-intake duct 13 and represents here the functional element 52. Engaging with the groove 82 are, e.g. saw-tooth-shaped, detents 83, either one circumferentially, or several separately on the inner wall of the connecting piece 7, said detents 83 preventing the gas distributor apparatus 1 from being disconnected or breaking away from the gas-intake duct 13. The at least one detent 83 is so configured on the connecting piece 7 that it is very simple to slide the connecting piece 7 toward the fuel injector 2 on to the gas-intake duct 13 up to the groove 82, while a movement in the opposite direction is prevented, similarly to a form-controlling safety catch. The gas distributor apparatus 1 is only to be separated from the gas-containing body 3 by exerting force to radially spread apart the connecting piece 7. A recess 85, in which is arranged a sealing element 86, e.g., as a sealing ring or as a hose section premolded in the connecting piece 7, can be provided on the front side 77 of the gas-intake duct 13 to ensure a sealing action between the gas distributor apparatus 1 and the gas-intake duct 13.

Figure 4:
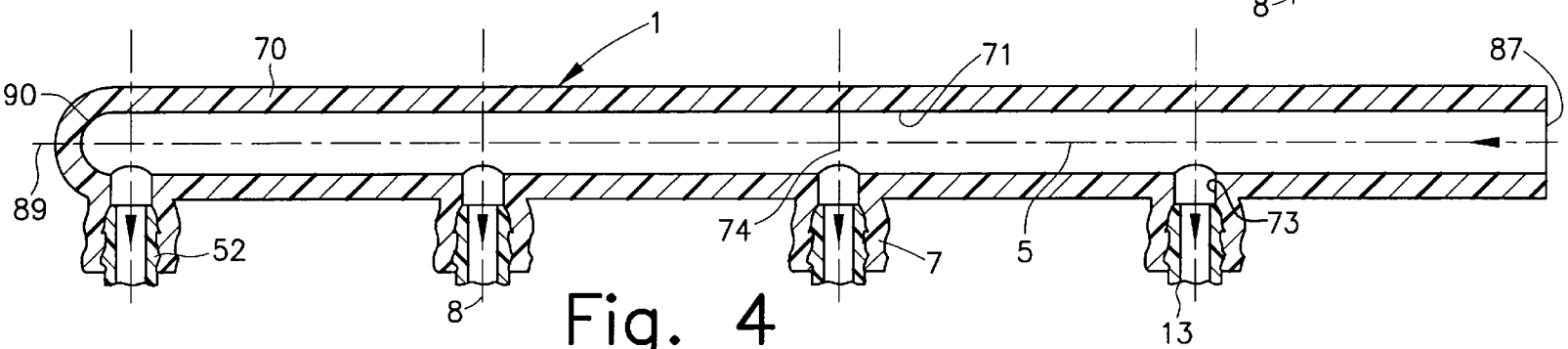
FIG. 4 shows a longitudinal view of the gas distributor apparatus, in section, according to the present invention.

FIG. 4 shows a simplified and schematic longitudinal view of the gas distributor apparatus 1 comprising four connecting pieces 7 according to an embodiment of the present invention as depicted in FIG. 1. The substructure of the gas distributor apparatus 1 is the tubular, elongated gas-supply line 70, which extends concentrically to the longitudinal axis 5 of the gas distributor and has at least one open end 87, which communicates directly with a gas-supply source (not shown).

The length of the supply orifice 71 inside the gas-supply line 70 corresponds thereby at least to the distance between the center axes 74 of the two most distant branched-off ports 73, thus, here the distance between the center axis 74 of the first branched-off port 73 and the center axis 74 of the fourth branched-off port 73. The open end 87 can also be designed to facilitate the attachment of a supply hose, such as the connection piece 99 shown in FIG. 6. The distributor end 89 opposite the open end 87 is, e.g., completely closed, so that the supply orifice 71 inside the gas-supply line 70 likewise has a closed end area 90. It is also conceivable, however, for the gas-supply line 70 to have a completely tubular design with two open ends, either both of them communicating directly with the gas-supply source or via a back coupling of the one end to the other.

Figure 5:
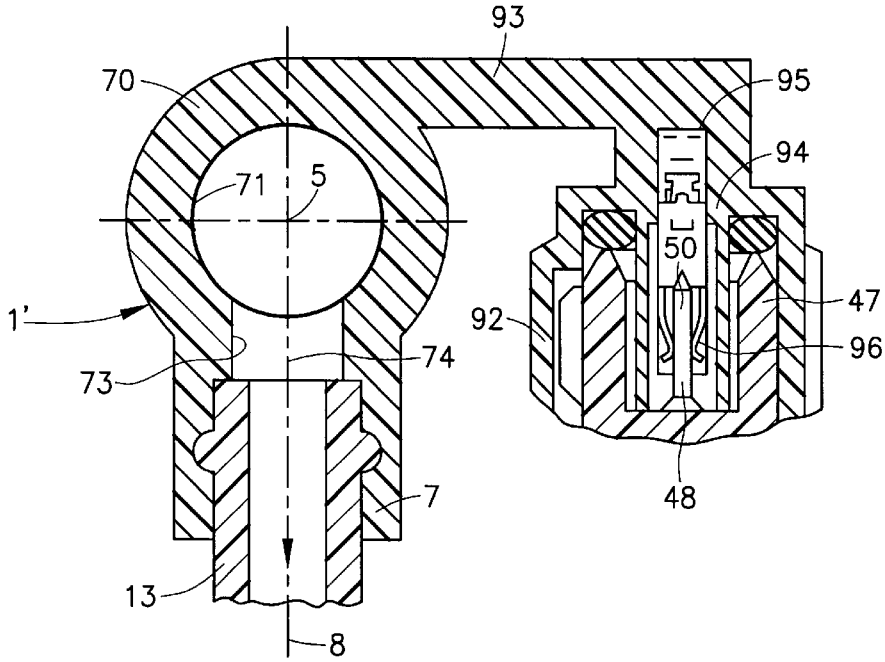
FIG. 5 shows a partial representation of the gas distributor apparatus together with a connecting element and a socket connector strip according to the present invention.
Figure 6:
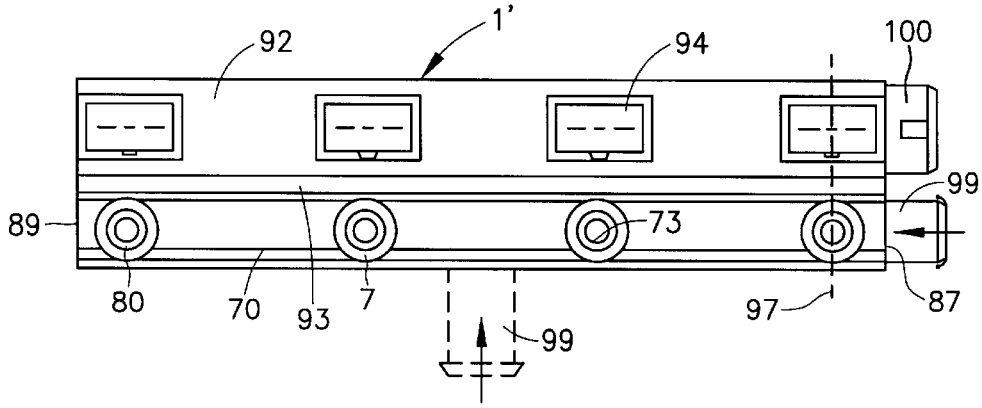
FIG. 6 shows a longitudinal view of the whole gas distributor apparatus including a gas-supply line and socket connector strip.

Another embodiment of the gas distributor apparatus 1 is depicted in FIGS. 5 and 6 and characterized by the reference symbol 1'. The gas distributor apparatus 1' is now produced in one piece together with an electrical socket connector strip 92, a connecting element 93 running between the gas-supply line 70 and the socket connector strip 92. The gas distributor apparatus 1' is expediently manufactured from a plastic. FIGS. 5 and 6 are merely simplified illustrations, drawn to clarify the principal design layout of the gas distributor apparatus 1'. The electrical socket connector strip 92 has sockets 94, which correspond to the plug connectors 47 and whose number conforms to the number of fuel injectors 2 and, thus, to the number of plug connectors 47, so that each fuel injector 2 is electrically contacted via a connector-socket pairing. As is generally known, the electrical contacting via the connector-socket pairing system is carried out comparably to the electrical contacting via the plug-and-socket connections customary on fuel injectors 2 or other devices or units. The connector elements 96 of the sockets 94 are resiliently designed to realize force-locking contacts with the connector pins 48 at their unattached pin ends 50. The electrical socket connector strip 92 accommodates electrical conductors 95, which are connected to the connector elements 96 for contacting the fuel injectors 2. The combined gas distributor apparatus 1', which comprises the gas-supply line 70 and the socket connector strip 92, constitutes a very simple and compact arrangement that fulfills two functions, namely supplying the fuel injectors 2 with gas to contain (and entrain) the fuel, inter alia, to reduce emissions, and providing at the same time for the electrical contacting of the fuel injectors 2.

FIG. 6 gives a schematic overview of the entire gas distributor apparatus 1'. The gas-supply line 70, the socket connector strip 92 and the connecting element 93 connecting the two have, e.g., the same axial extent. The connecting pieces 7 and the sockets 94 are arranged in each case directly opposite one another, since usually the plug connector 47 and the gas-intake duct 13 are arranged on the periphery of the fuel injector 2 from a meridian, thus from a line running parallel to the longitudinal valve axis 9, as indicated by the dotted line 97. Besides the possibility shown in FIG. 4 of making a gas available for the gas-supply line 70 from a lateral side, especially from the open end 87, it is also possible for gas to be supplied from the longitudinal side of the gas distributor apparatus 1', as shown by the connection piece 99 depicted with dotted lines. The electrical connection is made, e.g. to an electronic control unit, via a plug connector 100, which is arranged at any desired end of the socket connector strip 92 and is connected to the electrical conductors 95 and which is designed, e.g., on the same front side as the open end 87 of the gas-supply line 70.

The gas distributor apparatus 1, 1' comprising the connecting pieces 7 for accommodating the gas-intake ducts 13 of the gas-containing body 3 of fuel injectors 2 for injecting a fuel-gas mixture and comprising a central gas-supply line 70 serving for supplying gas to the fuel injectors 2 makes it possible to simply and reliably supply a gas to the fuel injectors 2 or to other devices.

What is claimed is:

1. A gas distributor apparatus for a fuel-injection system of an internal combustion engine, the gas distributor apparatus comprising:

a plurality of fuel injecting devices;

a gas-supply line supplying gas to the plurality of fuel injecting devices, wherein the gas-supply line defines a gas-supply orifice extending substantially along a longitudinal gas-distributor axis of the gas-supply line; and a plurality of connecting pieces coupled to the gas-supply line and conforming in number to the plurality of fuel injecting devices, each of the connecting pieces defining a branched-off port in fluid communication with the gas-supply orifice extending to a respective one of the plurality of fuel injecting devices, wherein the gas-supply orifice is not constricted by any of the plurality of branched-off ports and wherein a length of the gas-supply orifice is at least as long as a distance between a center axis of a first one of the branched-off ports and a center axis of a last one of the branched-off ports, and wherein the plurality of connecting pieces supply gas to the plurality of injecting devices through gas-intake ducts of gas-containing bodies and include locking members, the gas-containing bodies enclosing the plurality of injecting devices, the gas-intake ducts cooperating with the locking members of the connecting pieces for supplying gas to the plurality of injecting devices.

2. A gas distributor apparatus for a fuel-injection system of an internal combustion engine, the gas distributor apparatus comprising:

a plurality of fuel injecting devices;

a gas-supply line supplying gas to the plurality of fuel injecting devices, wherein the gas-supply line defines a gas-supply orifice extending substantially along a longitudinal gas-distributor axis of the gas-supply line; and a plurality of connecting pieces coupled to the gas-supply line and conforming in number to the plurality of fuel injecting devices, each of the connecting pieces defining a branched-off port in fluid communication with the gas-supply orifice extending to a respective one of the plurality of fuel injecting devices, wherein the gas-supply orifice is not constricted by any of the plurality of branched-off ports and wherein a length of the gas-supply orifice is at least as long as a distance between a center axis of a first one of the branched-off ports and a center axis of a last one of the branched-off ports, and wherein the gas-supply line is formed with the gas distributor apparatus as a single piece, the gas-supply line running along the longitudinal gas-distributor axis of the gas distributor, and wherein the gas-supply line includes an electrical socket connector strip having electrical conductors for electrically contacting the plurality of injecting devices.

3. The gas distributor apparatus as recited in claim 2, wherein the gas-supply line is coupled to the electrical socket connector strip via a connecting element.

4. The gas distributor apparatus as recited in claim 3, wherein the gas-supply line, the electrical socket connector strip and the connecting element extend substantially along the longitudinal gas-distributor axis the gas distributor.

5. The gas distributor apparatus as recited in claim 1, wherein the gas distributor apparatus is composed of a plastic material.

6. A gas distributor apparatus for a fuel-injection system of an internal combustion engine, the gas distributor apparatus comprising:

a plurality of fuel injecting devices;

a gas-supply line supplying gas to the plurality of fuel injecting devices, wherein the gas-supply line defines a gas-supply orifice extending substantially along a longitudinal gas-distributor axis of the gas-supply line; and a plurality of connecting pieces coupled to the gas-supply line and conforming in number to the plurality of fuel injecting devices, each of the connecting pieces defining a branched-off port in fluid communication with the gas-supply orifice extending to a respective one of the plurality of fuel injecting devices, wherein the gas-supply orifice is not constricted by any of the plurality of branched-off ports and wherein a length of the gas-supply orifice is at least as long as a distance between a center axis of a first one of the branched-off ports and a center axis of a last one of the branched-off ports, wherein the gas distributor apparatus is composed of a rubber material.

7. The gas distributor apparatus as recited in claim 1, wherein the gas-supply line has a tubular shape and a substantially circular cross-section.

8. The gas distributor apparatus as recited in claim 1, wherein the plurality of connecting pieces are at least partially fitted with the gas-intake ducts for cooperating each of the gas-intake ducts with the corresponding one of the branched-off ports, the gas-intake ducts radially enclosing the plurality of branched-off ports.

9. The gas distributor apparatus as recited in claim 8, wherein the plurality of connecting pieces are elastically formed, and wherein the plurality of connecting pieces are fitted with the corresponding gas-intake ducts by deforming the plurality of connecting pieces when the plurality of connecting pieces are installed on the gas-intake ducts, and the plurality of connecting pieces are fitted with the gas-intake ducts to provide a radially acting tension.

10. The gas distributor apparatus as recited in claim 1, wherein the gas-supply line includes an open end and a distributor closed end, the open end being situated opposite to the distributor closed end, the supply orifice being positioned in the gas-supply line and including a closed end region situated at the distributor closed end.

11. The gas distributor apparatus as recited in claim 10, wherein each of the plurality of branched-off ports has a branched diameter smaller than a supply orifice diameter of the supply orifice of the gas-supply line.

12. The gas distributor apparatus as recited in claim 8, wherein each of the plurality of branched-off ports has a graduated profile for providing at least one sealing element, each of the at least one sealing element generating a sealing action with the gas-intake ducts.

* * * * *

UNITED STATES PATENT AND TRADEMARK OFFICE

CERTIFICATE OF CORRECTION

PATENT NO. : 6,626,159 B1
DATED : September 30, 2003
INVENTOR(S) : Waldemar Hans et al.

It is certified that error appears in the above-identified patent and that said Letters Patent is hereby corrected as shown below:

Column 9,
Line 27, change “axis the gas” to -- axis of the gas --.

Signed and Sealed this

Twenty-second Day of June, 2004

JON W. DUDAS
*Acting Director of the United States Patent and Trademark Office*